US006243044B1

(12) United States Patent
Scott

(10) Patent No.: US 6,243,044 B1
(45) Date of Patent: Jun. 5, 2001

(54) ANTENNA MOUNT FOR VEHICLES

(75) Inventor: Vester Scott, Lawrenceville, GA (US)

(73) Assignee: Maximum Mobile, Inc., Lawrenceville, GA (US)

( * ) Notice: Subject to any disclaimer, the term of this patent is extended or adjusted under 35 U.S.C. 154(b) by 0 days.

(21) Appl. No.: 09/573,313

(22) Filed: May 18, 2000

(51) Int. Cl.[7] ..... H01Q 1/32

(52) U.S. Cl. ..... 343/715; 343/713; 343/881; 248/237; 248/536

(58) Field of Search ..... 343/713, 715, 343/880, 881, 882, 878, 900, 888, 892; 248/237, 148, 516, 536; H01Q 1/32

(56) References Cited

U.S. PATENT DOCUMENTS

| | | | | |
|---|---|---|---|---|
| 2,891,748 | | 6/1959 | Winegard . | |
| 3,452,956 | | 7/1969 | Reed . | |
| 3,734,232 | * | 5/1973 | Shepherd | 181/0.5 |
| 3,967,275 | | 6/1976 | Wagman . | |
| 4,028,705 | | 6/1977 | Loyd . | |
| 4,028,706 | | 6/1977 | Dolle . | |
| 4,054,794 | * | 10/1977 | Laughlin et al. | 250/199 |
| 4,099,185 | | 7/1978 | Hacker et al. . | |
| 4,161,735 | | 7/1979 | Zylla . | |
| 4,185,288 | * | 1/1980 | Dosch et al. | 343/765 |
| 4,249,182 | | 2/1981 | Rupley . | |
| 4,510,502 | | 4/1985 | Hovland et al. . | |
| 4,543,584 | | 9/1985 | Leer . | |
| 4,748,451 | * | 5/1988 | Edwards | 343/880 |
| 5,259,612 | | 11/1993 | Matherne et al. . | |
| 5,308,029 | * | 5/1994 | Bingham | 248/159 |
| 5,829,724 | | 11/1998 | Duncan . | |
| 5,999,139 | * | 12/1999 | Benjamin et al. | 343/765 |

* cited by examiner

*Primary Examiner*—Tho Phan
(74) *Attorney, Agent, or Firm*—Hinkle & Associates, P.C.

(57) ABSTRACT

A multi-legged antenna mounting system for vehicles, to resist high wind loading on the antenna, having at least three mounting legs positioned to the vehicle by clamping members or by magnetic attracting members. The legs of the mounting system are secured to an antenna connecting assembly unit in order that a plurality of the legs are adjustably secured for various angular dispositions with respect to the vehicle. One of the legs of the mounting system comprises the antenna element.

6 Claims, 2 Drawing Sheets

12
11
34
34
35
36
37
43
27
13
13
26
25
17
14
24
15
19
18
25
14
24
15
17
21
19
18
16
21
22
14
26
25
15
24
17
21
21
19
18
22
17

ANTENNA MOUNT FOR VEHICLES

BACKGROUND OF THE INVENTION

I. Field of the Invention

The present invention relates generally to the field of antenna mounts and more particularly to antenna mounting systems for vehicles wherein the antennas which are utilized present very high wind loads at highway speeds which causes extreme pressure on the antenna mounting system affixed to the vehicle. The antenna system of the present invention typically will lock and secure the antenna to the trunk lid of the vehicle by a unique stabilizing and reinforcing antenna mounting means.

II. Description of the Related Art

Historically, mobile radio operators have been forced by available mechanical support limitations to compromise the radiation efficiency of high wind load antennas typically used in the high frequency bands by mounting them on the periphery of the vehicle. Typical of such peripheral mounting mechanisms would encompass the front and rear bumpers of the vehicle, inasmuch as this is a strong point on most vehicles. However, from a radiation efficiency standpoint, the optimum location on the vehicle for any antenna is always near the horizontal center of mass of the vehicle body.

Mounting antennas on the trunk or hood of the vehicle, these being convenient locations on most vehicles, however, yields nearly the same radiation efficiency of a roof center mounting while providing cost savings and mounting ease opportunities not easily achieved with roof mounting. An important advantage of trunk lip mounting over roof center mounting for many antenna types is the increased radiating element length that is possible when the bottom of the antenna may be placed doser to the ground. This increases the physical length of the antenna without exceeding the normal legal over-the-road height limit, typically at 13'6", for obstruction clearance. For radiation efficiency purposes, the optimum physical length of vertical antennas, which are frequently used in mobile radio service, is ¼ wave length. Any physical length for a given frequency that is less than ¼ wave length will be electrically sub-optimal. The practical limit for the physical length of a mobile radio antenna is established only by the actual overhead clearance in the area being traversed by the vehicle. However, as noted above, the legal limit for vehicles operating on public roads is typically 13'6" from the ground to the top of the antenna.

Therefore, it will be obvious that some means of approaching the electrical equivalence of a mobile radio antenna at lower frequencies without exceeding the physical height restriction above the ground is quite desirable. In order to achieve a good radiation efficiency for an antenna, the addition of a relatively large diameter coil, called a loading coil, somewhere along the length of the antenna is required. With the addition of a loading coil, the optimum physical antenna length may now be physically constructed to a shorter form factor. It is this form factor that can produce significant wind load at highway speeds on mobile radio antenna installations, especially those operating below 14 MHz.

Not only will vertically polarized mobile radio antennas benefit by the present invention, but horizontally polarized mobile radio antennas can achieve the same physical and radiation efficiency benefits by the use of the present invention. Horizontally polarized mobile radio antennas typically yield wind loads approaching those of vertically polarized antennas and, in addition, overhead clearance questions may also be a consideration in any stacked array antenna system of any horizontally polarized antenna systems.

The prior art is replete in antenna mounting systems and such systems have been used with antennas of many different configurations. Typical of many vehicle antenna mounting systems are magnetic mounts such as shown in U.S. Pat. No. 4,543,584 to Leer which disclose a horizontally disposed triangular mounting system having magnets at the distal ends of the mount legs for securing to a metal portion of a vehicle. This type of mount, however, will not support a high wind load antenna.

In U.S. Pat. No. 3,967,275 to Wagman and U.S. Pat. No. 4,249,182 to Rupley, clamp-on antenna mounts are shown which are typically clamped to a rearview mirror which is in turn attached to the side of the vehicle cab. While these antenna mounts show a multi-leg attachment system, the mounts are not designed to support high wind load antenna systems.

A typical truck lid mounting system is shown in U.S. Pat. No. 4,028,706 to Dolle, but, again, the system is quite flimsy and will not sustain high wind loading stresses.

BRIEF SUMMARY OF THE INVENTION

In accordance with the present invention and the contemplated problems which have existed and continue to exist in this field, the objectives of this invention are to provide a multi-legged antenna mounting system for vehicles which may typically be mounted to the vehicle trunk wherein at least three mounting legs are positioned along the periphery of the trunk lid by suitable clamping members and thence terminate at an insulated antenna connecting assembly unit. The legs of the antenna mount system are capable of being positioned with respect to the insulated antenna connecting assembly unit in a variety of angular dispositions to enable the legs to be affixed to the vehicle trunk lid. Each leg at the distal end thereof terminates in a deck mounting unit which is designed to fixedly mount each leg to the lid. It is anticipated that prior art mounting systems for this purpose will be utilized with the present invention. For stability sake, the antenna is incorporated as one of the mounting legs. All of the legs, including the antenna, will be incorporated into the insulated antenna connecting assembly unit to provide the structural stability needed for the high wind loading capabilities of the present invention.

The invention does not block access to either the trunk interior of the vehicle or to the hood interior if the unit is mounted on the hood of the vehicle, inasmuch as the antenna system simply moves to a more or less horizontal position when the trunk lid or the hood is opened. The various components of the invention are commonly used materials and the vehicle deck mounting units are standard off-the-shelf components. By using at least three mounting legs to support the unit, one of the legs being the antenna itself, there is a certain amount of functionality, endurance and resilience which occurs that exceed that of the sum of the mounts by orders of magnitude. Antennas of any reasonable size may be mounted as part of the system disclosed herein and will be fully supported during normal high wind load conditions. The present invention also contemplates the use of magnetic foot mounts for securing the legs of the assembly to the vehicle, as opposed to mechanical lid mounts, and it has been found that such magnetic mounts, properly sized, will perform adequately in high wind load conditions.

Other objects, advantages and capabilities of the invention will become apparent from the following description taken in conjunction with the accompanying drawings showing the preferred embodiment of the invention.

SRIEF DESCRIPTION OF THE DRAWINGS

DETAILED DESCRIPTION OF THE INVENTION

Figure 1:
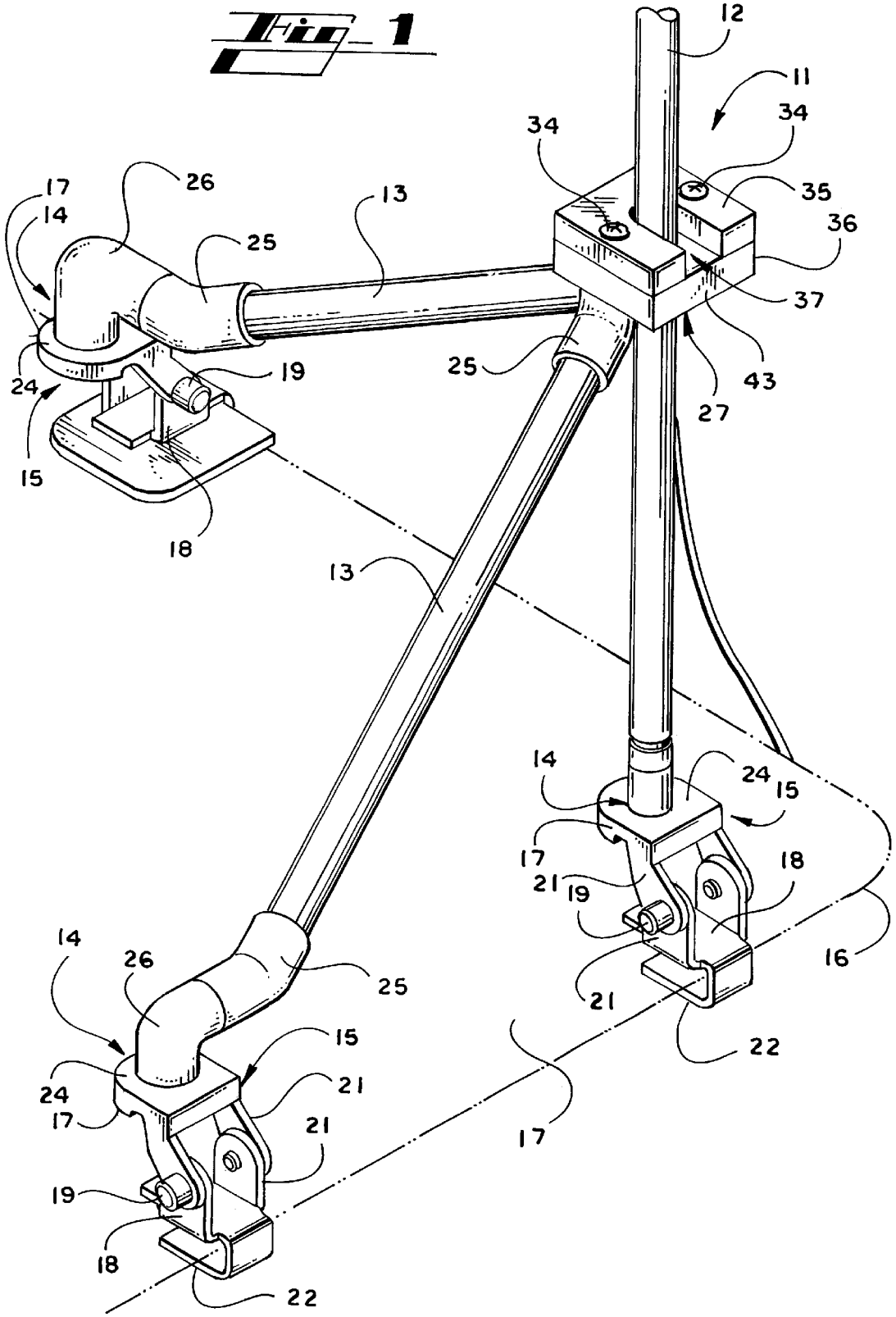
FIG. 1 is a perspective view of the multi-point antenna mounting system of the present invention shown fixed upon a deck of a vehicle.
Figure 4:
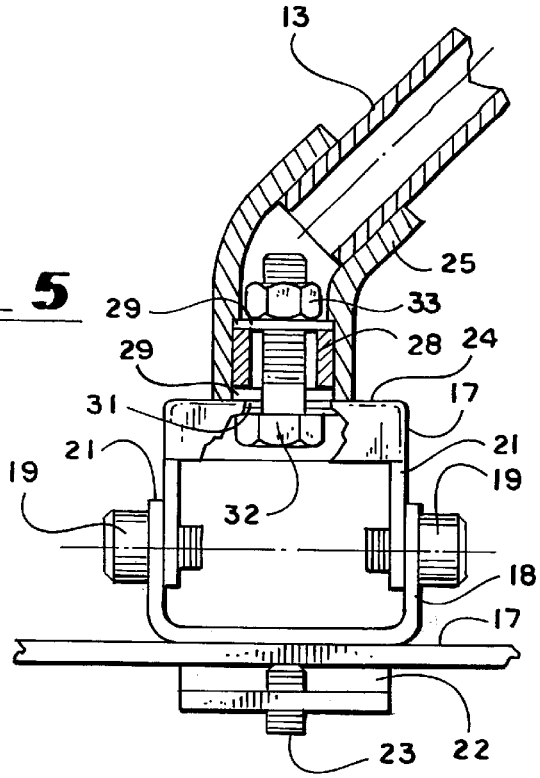
Fig. 4 PRIOR ART
FIG. 4 is a partial section view of a typical vehicle deck mount unit of the prior art showing the interconnection of one antenna support leg mounted thereto.

Referring to the drawings wherein like reference numerals designate corresponding parts throughout the several figures, reference is made first to FIG. 1 showing the multi-point antenna mounting system 11. FIG. 1 discloses a three point mounting system, however, it is contemplated that under high wind loading conditions it may be necessary to have four or more support legs for the system and such is contemplated herein. The system 11 comprises an antenna element 12 of any suitable design and two or more struts 13. The respective distal ends 14 of the antenna element 12 and the struts 13 are mounted to commercially available deck mount units 15. For securing purposes, the deck mount units 15 would then be mounted in typical fashion around the peripheral edge 16 of the vehicle deck lid 17. A typical type of deck mount unit 15 is one made by Comet Co., Ltd., Model RS-9. This type of mount unit comprises an upper mount body 17 and a lower mount body 18 which are interconnected by means of clamping screws 19, which connect respective connecting ears of the upper and lower mount bodies to retain the bodies in respective alignment with one another. The mount units 15 are attached to the vehicle deck lid 17 by means of a reentrant clamping flange 22 which encompasses the peripheral edge 16 of the vehicle deck lid 17. Securing the clamping flange to the deck lid will typically be a clamp fastener 23 which projects through the clamping flange 22 and impinges upon the underside of the deck lid 17. Each of the distal ends 14 of the respective struts 13 and the distal end of the antenna element 12, are respectively connected to the mounting plates 24 of each deck mount unit 15. The specific mounting arrangement is clearly shown in FIG. 4.

The distal end 14 of each strut 13 will terminate in suitable mounting components such as a 45° elbow joint 25 and a 90° elbow joint 26. Obviously, the angular requirements of the mount will be dictated by the height of the insulated antenna connecting assembly unit 27 supporting and placed around the antenna element 12. The lower end of elbow joint 26 will be typically hollow and will have placed therein a tubing spacer 28 firmly cemented therein for the purpose of spacing apart retaining washers 29. Placed through aperture 31 in the mounting plate 24 is a securing bolt 32 which terminates in a nut 33 so as to flank the retaining washers 29, and to maintain the distal ends of struts 13 and the distal end of the antenna element 12 firmly against the mounting plate 24 of the deck mount unit 15. It should be noted that the struts 13, along with the various fittings 25 and 26, are contemplated to be made from chlorinated polyvinyl chloride tubing (CPVC) which is easily obtainable on the commercial market. This type of tubing is of extremely durable dielectric material and does not alter the radiation characteristics of the antenna.

It is noted that the struts 13 may be made to various lengths to conform to the vehicle mounting requirements, and that the struts 13 are adjustably mounted to both the deck mount unit 15 and to the connecting assembly unit 27 so as to be angularly adjustable to present the antenna element in a vertical orientation.

Figure 3:
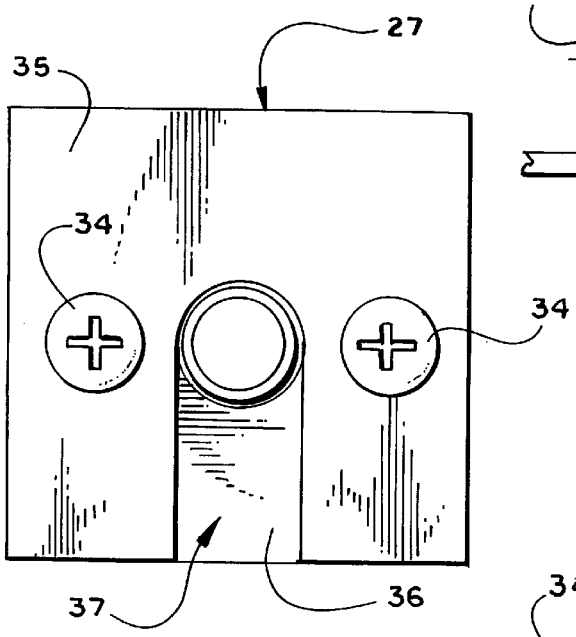
FIG. 3 is a top view of the insulated antenna connecting assembly unit with the antenna in section view.
Figure 2:
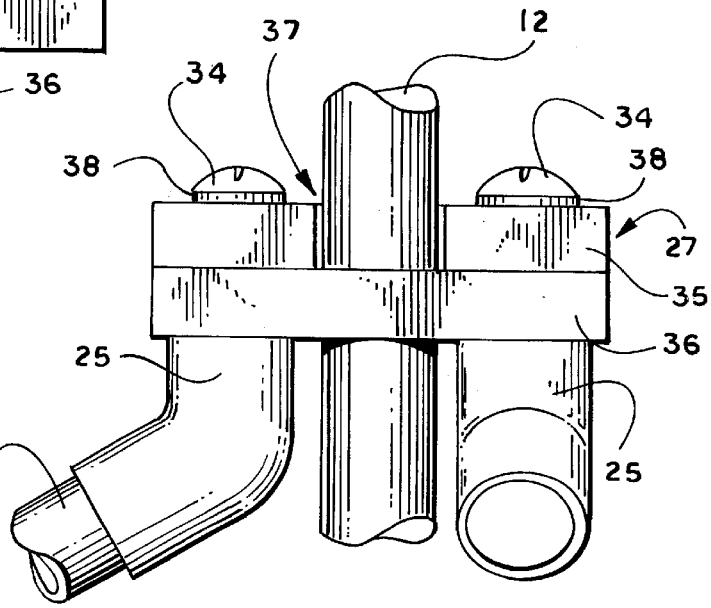
FIG. 2 is a partial elevation view of the insulated antenna connecting assembly unit with close-up views of the connecting mechanism of the support legs.

Maintaining the entire structure in a rigid high wind resistant loading configuration is the insulated antenna connecting assembly unit 27. As seen in both FIGS. 1 and 2, the struts 13 terminate in an elbow joint 25 on a lower surface of the assembly unit 27 and are secured thereto by securing fasteners 34 which are placed within the elbow joint 25 much in the same manner as just described for the elbow joint 25 attached to the mounting plate 24. The assembly unit 27 generally comprises a pair of identical molded high density, durable dielectric plates indicated by numeral 35 representing the upper plate member and numeral 36 representing the lower plate member. Each of the respective plate members 35 and 36 are generally rectangular in configuration with a suitable thickness, defining at least one edge surface 43, to maintain a rigid configuration. Each of the plates has an antenna element access opening of U-shaped configuration indicated by numeral 37. It should be noted that the access openings 37 are dictated in size solely by the diameter of the supported antenna element 12 whose size in turn is dictated by the desired transmitting characteristics of the installation. As seen in FIG. 3, the upper and lower plate members 35 and 36 overlie one another and firmly engage the antenna element 12 for secure support. In order to accomplish this task, the respective U-shaped access openings 37 are oppositely oriented with respect to one another so that the interior curved portion of the U-shaped opening of the plate members impinge upon the antenna element on opposite sides thereof, thereby securing the element within a defined opening within the juxtaposed plate members which are then subsequently secured to one another and to the struts 13 by the securing fasteners 34. For maintaining the securing fasteners 34 in a locked position, lock washers 38 will be employed underneath the heads of the securing fasteners 34. The securing fasteners 34 will then be tightened and threaded into a nut (not shown) which is embedded within elbow joint 25 adjacent the lower surface of the lower plate member 36. The securing attachment of the fasteners 34 will be much in the same manner as described for the bolt and nut assembly of the deck mount unit 15.

It will be seen that once the multi-point antenna mount system 11 is fully assembled, there is an extremely strong rigid mounting system available for antenna element 12 and that the antenna element also functions as one leg in the multi-point assembly. Such a system presents an extremely rigid and durable high wind loading antenna mounting system which has not been known in the prior art.

Figure 5:
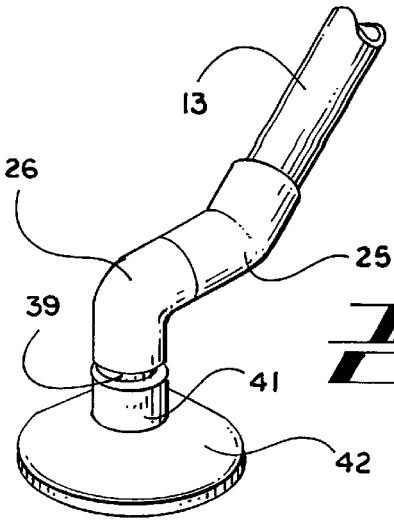
FIG. 5 is a partial perspective view of a support leg terminating in a magnet mount.

It may be that users of the present system will deem it advisable, in certain situations, not to utilize the type of deck mounting units 15 shown in the present drawings. It may well be that certain users will desire to place the antenna mount system 11 upon a surface of a vehicle by means of a magnet-type mounting system. Such a system is shown as an alternative embodiment in FIG. 5. To accomplish this type of mounting system, the distal ends 14 of the respective elements would typically terminate in a joinder section 39 which would couple elbow joint 26 to a support base 41 which would terminate in a very strong magnetic mounting member 42. In this fashion, the mount 42 would be placed upon the vehicle deck lid 17 and, depending upon the strength of the magnet, the antenna mount system would be firmly attached to the vehicle to achieve stability in high wind loading situations.

Therefore, the foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

It is further contemplated that a combination of deck mount units 15 and magnet mount units 42 could be utilized should it be deemed appropriate to mount the system on a particular vehicle. For instance, one could use deck mount units 15 on each strut 13, but also use a magnetic unit 42 on the antenna element 12 to secure it to the vehicle. This combination makes the system very adaptable to varying conditions.

What is claimed is:

1. An antenna mounting structure for a vehicle comprising:

a plurality of mounting legs connected at the distal ends thereof to the vehicle by a deck mounting unit, one of said mounting legs being an antenna element and the remaining legs being supporting struts, a connecting assembly unit being spaced from the vehicle and joining proximal ends of the struts to the connecting assembly unit, the connecting assembly unit being placed in a supporting relationship with the antenna element, the connecting assembly unit comprises an upper member and a lower member, the upper member being fixedly placed adjacent to and in an overlying relationship with the lower member, and each of the upper and lower members of the connecting assembly unit have at least one edge surface of predetermined thickness, a centrally located U-shaped aperture in each of the upper and lower members, the open end of each U-shaped channel terminating in the respective edge surface of the respective upper and lower members.

2. The antenna mounting structure as claimed in claim 1 wherein the U-shaped channel of the upper member is overlaid with and is oriented to the U-shaped channel of the lower member to define an aperture into which the antenna element is received.

3. The antenna mounting structure as claimed in claim 2 wherein the supporting struts are made of chlorinated polyvinyl chloride.

4. The antenna mounting structure as claimed in claim 2 wherein the distal ends of each of the supporting struts are adjustably mounted to the respective deck mounting unit.

5. The antenna mounting structure as claimed in claim 2 wherein each supporting strut has a proximal end adjustably mounted to the connecting assembly unit.

6. The antenna mounting structure as claimed in claim 2 wherein each deck mounting unit comprises a support base connected to the distal end of each mounting leg, a magnet integral with each support base to mount the antenna mounting structure to the vehicle.

* * * * *